US006842591B2

(12) United States Patent
Shim et al.

(10) Patent No.: US 6,842,591 B2
(45) Date of Patent: Jan. 11, 2005

(54) METHOD OF CONTROLLING CHARGING POTENTIAL OF CONDUCTIVE ROLLER IN PRINTER AND APPARATUS THEREFOR

(75) Inventors: Woo-jung Shim, Suwon-si (KR); Seung-deog An, Yongin-si (KR); Min-seon Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/354,181

(22) Filed: Jan. 30, 2003

(65) Prior Publication Data

US 2003/0219267 A1 Nov. 27, 2003

(30) Foreign Application Priority Data

May 23, 2002 (KR) ..... 10-2002-0028654

(51) Int. Cl.[7] ..... G03G 15/02
(52) U.S. Cl. ..... 399/50; 399/89; 399/176
(58) Field of Search ..... 399/56, 89, 176; 361/235

(56) References Cited

U.S. PATENT DOCUMENTS 5,749,022 A 5/1998 Kikui et al.
6,278,103 B1 * 8/2001 Takami ..... 250/214 R
6,564,023 B2 * 5/2003 Takami et al. ..... 399/50

FOREIGN PATENT DOCUMENTS

JP 4-125069 A * 4/1992
JP 2002-287466 A * 10/2002

* cited by examiner

*Primary Examiner*—Arthur T. Grimley
*Assistant Examiner*—Ryan Gleitz
(74) *Attorney, Agent, or Firm*—Staas & Halsey LLP

(57) ABSTRACT

A method of controlling a charging potential of an organic photoconductive cell (OPC) includes a first operation of applying two charging voltages Vc1 and Vc2 having respective duties D1 and D2 established in an engine controller unit (ECU) to a conductive roller via a high voltage power supply (HVPS) to charge the OPC, a second operation of measuring sensing voltages Vs1 and Vs2 through a sensing resistor Rs coupled to the conductive roller so that the ECU establishes a target charging current it and calculates a new charging voltage Vc3 and a new duty D3, a third operation of applying the new charging voltage Vc3 and the new duty D3 to the conductive roller via the HVPS to charge the OPC and measuring a charging current Ic3 of the conductive roller, and a fourth operation of comparing a difference between the charging current Ic3 of the conductive roller and the target charging current It with a tolerance value TOL to control the charging potential by using the target charging current when the difference is smaller than the tolerance value TOL. The method maintains the charging potential by compensating for a residual potential of the OPC, thus improving a performance of a printer.

34 Claims, 7 Drawing Sheets

METHOD OF CONTROLLING CHARGING POTENTIAL OF CONDUCTIVE ROLLER IN PRINTER AND APPARATUS THEREFOR

CROSS-REFERENCE TO RELATED APPLICATIONS

This application claims the priority of Korean Patent Application No. 2002-28654, filed May 23, 2002, in the Korean Intellectual Property Office, which is incorporated herein in its entirety by reference.

BACKGROUND OF THE INVENTION

1. Field of the Invention

The present invention relates to a method of controlling a charging potential of a charging mechanism having a conductive roller in a printer, and more particularly, to a method of controlling a charging potential of a conductive roller by using a sensing resistance in a printer.

2. Description of the Related Art

A printer generally includes an organic photoconductive cell (OPC), a discharging mechanism eliminating a potential of the OPC, a charging mechanism increasing the potential of the OPC to a charging potential, an exposure mechanism radiating a beam on the OPC to form an electrostatic latent image, a development mechanism supplying a developing solution to the OPC to develop the electrostatic latent image, a drying mechanism drying an image formed on the OPC, and a transfer mechanism transferring the image on the OPC to a sheet.

The charging mechanism supplies a predetermined charging voltage to the OPC after the OPC is discharged, so as to increase the potential of the OPC to a predetermined charging potential level. Here, if a charging characteristic of the OPC is changed due to continuous use of the printer, a residual potential of the OPC increases, and thus the charging potential of the OPC does not increase in proportion to the supplied charging voltage. When the charging potential of the OPC does not increase to the predetermined level, a difference between the charging potential of the OPC and an exposure potential of the exposure mechanism or the charging potential of the OPC and a development potential of the development mechanism decreases so that a desired image cannot be printed.

Generally, a resistance of a conductive roller of the charging mechanism may increase as much as about ten times according to changes in temperature and moisture, and thus the charging potential of the OPC seriously fluctuates. When the temperature and the moisture are low, and the charging potential of the OPC is also low, contamination may occur in a non-image region of the sheet. When the temperature and the moisture are high, and the charging potential of the OPC is also high, a printing quality of an output image is lowered.

Accordingly, it is necessary to control the charging potential of the OPC to be within a predetermined range.

FIGS. 1 and 2 are schematic views illustrating conventional methods of controlling a charging potential of an OPC 13 by using a conductive roller 11 in a conventional charging mechanism.

FIG. 1 is a schematic view illustrating the conventional method of controlling the charging potential of the OPC 13 by using a surface electrometer.

In order to charge the OPC 13 to a predetermined potential level, an engine controller unit (ECU) 21 outputs a voltage signal to a high voltage power supply (HVPS) 23, and the HVPS 23 receives the voltage signal and applies a high voltage of about 700 to 1500 V to a metal shaft of the conductive roller 11. Accordingly, a strong electric field is formed between a surface of the conductive roller 11 and the OPC 13 so that a Townsend discharge occurs, and corona ions accumulate in the OPC 13 to charge the OPC 13.

As a printing operation is performed, the potential of the OPC 13 is varied to print images. Here, the charging potential of the OPC 13 cannot be maintained to be uniform due to changes in internal and external environments. Since the changes in the charging potential of the OPC 13 may cause deterioration of the printing quality of the output image, it is required to maintain the charging potential within a tolerance range.

The conventional method of controlling a charging potential of FIG. 1 detects the charging potential by using a surface electrometer 15 located on a surface of the OPC 13 and outputs an analog signal about the detected charging potential to a sensor board 17. Thereafter, an analog-to-digital converter (ADC) 19 converts the analog signal into a digital signal. The ECU 21 receives the digital signal and establishes a new target charging voltage considering a difference between the detected charging potential and a target potential and outputs an adjusted voltage signal to the HVPS 23 so as to control the charging voltage of the conductive roller 11.

FIG. 2 is a schematic view illustrating another conventional method of controlling the charging potential of the OPC 13 by using a sensing resistance.

Referring to FIG. 2, a sensing resistor 25 outputs a charging current signal in proportion to the charging potential of the OPC 13. An operational (OP) amplifier 27 amplifies the charging current signal and outputs the amplified signal to the ECU 21. Thereafter, the ECU 21 outputs a charging voltage signal to control the HVPS 23 in response to a difference between the amplified charging current signal and a target charging potential so that the HVPS 23 applies a high voltage to a conductive roller 11.

Since the conventional method of using the surface electrometer requires a separate surface electrometer, a price of the printer increases. In addition, only the charging potential is measured by the surface electrometer so that an electrical characteristic of the OPC, i.e., an increase of a residual potential, cannot be measured. Consequently, the charging potential of the OPC cannot be precisely controlled.

The conventional method of using the sensing resistance may compensate for a variation of the resistance of the conductive roller when a charging current is maintained. However, the conventional method cannot compensate for the variation of the electrical characteristic of the OPC, i.e., the variation of the charging characteristic due to changes in the residual potential.

SUMMARY OF THE INVENTION

To solve the above and/or other problems, it is an aspect of the present invention to provide a method of controlling a charging voltage of a charging mechanism to maintain a charging potential of an organic photoconductive cell (OPC) within a predetermined range regardless of changes in a charging characteristic due to a variation of a residual potential of the OPC in a printer.

Additional aspects and advantages of the invention will be set forth in part in the description which follows and, in part, will be obvious from the description, or may be learned by practice of the invention.

To accomplish an aspect of the present invention, a method of controlling a charging voltage Vc of a charging mechanism in a printer includes a conductive roller charging an OPC, a sensing resistor Rs measuring a sensing voltage, which is proportional to a charging potential of the OPC, an analog-to-digital converter (ADC) converting an analog signal corresponding to a voltage variation of the sensing resistor Rs to a digital signal, an engine controller unit (ECU) receiving the digital signal from the ADC and outputting a control signal controlling the charging voltage Vc and a duty of a high voltage power supply (HVPS), and the HVPS receiving the control signal from the ECU and supplying the charging voltage Vc to the conductive roller. The method comprises a first operation of supplying two charging voltages Vc1 and Vc2 and duties D1 and D2 established in the ECU to the conductive roller via the HVPS to charge the OPC, a second operation of measuring sensing voltages Vs1 and Vs2 of the sensing resistor Rs so that the ECU establishes a target charging current It and calculates a new charging voltage Vc3 and a new duty D3, a third operation of supplying the new charging voltage Vc3 and the new duty D3 to the conductive roller via the HVPS to charge the OPC and measuring the charging current Ic3 of the conductive roller, and a fourth operation of comparing a difference between the charging current Ic3 of the conductive roller and the target charging current It with a tolerance value TOL to control the charging potential by using the target charging current It when the difference is smaller than the tolerance value TOL.

Here, the second operation further includes calculating charging currents Ic1 and Ic2, an equivalent resistance Rc of the conductive roller, and a sum Vtr of a residual potential Vres and a threshold voltage Vth by using Equations 1 through 4 which represent relationships between the charging voltages V1 and V2, the duties D1 and D2, and the sensing voltages Vs1 and Vs2, where Rf is a feedback resistance connected to the conductive roller in a series to transfer a feedback current If to the HVPS, and K is a proportional constant, extracting the residual potential Vres for the equivalent resistance Rc from a lookup table (LUT) to calculate the residual potential Vres by using the sum Vtr, establishing the target charging current It from the residual potential Vres, and calculating the new charging voltage Vc3 and the new duty D3 from the target charging current It.

$$Ic1 = \frac{Vs1}{Rs} - \frac{KD1}{Rf} \tag{1}$$

$$Ic2 = \frac{Vs2}{Rs} - \frac{KD2}{Rf} \tag{2}$$

$$Rc = \frac{Vc2}{Ic2} - \frac{Vc1}{Ic1} \tag{3}$$

$$Vtr = KD1 - Ic1 \times Rc = KD2 - Ic2 \times Rc \tag{4}$$

In establishing the target charging current It, when the residual potential Vres increases, the target charging current It is decreased, and when the residual potential Vres decreases, the target charging current It is increased.

In calculating the charging voltage Vc3 and the duty D3, the charging voltage Vc3 and the duty D3 satisfy Equations 5 and 6.

$$Vc3 = Vtr + ItRc \tag{5}$$

$$D3 = \frac{Vc}{K} \tag{6}$$

The fourth operation further includes controlling the charging mechanism by using the target charging current It when the difference between the target charging current It and the charging current Ic3 of the conductive roller is smaller than a tolerance value TOL, and repeating the first through third operations until the difference between the target charging current It and the charging current Ic3 of the conductive roller becomes smaller than the tolerance value TOL when the difference between the target charging current It and the charging current Ic3 of the conductive roller is larger than the tolerance value TOL.

BRIEF DESCRIPTION OF THE DRAWINGS

These and other objects and advantages of the present invention will become more apparent and more readily appreciated from the following description of the preferred embodiment, taken in conjunction with the accompanying drawings of which.

DETAILED DESCRIPTION OF THE PREFERRED EMBODIMENTS

Figure 1:
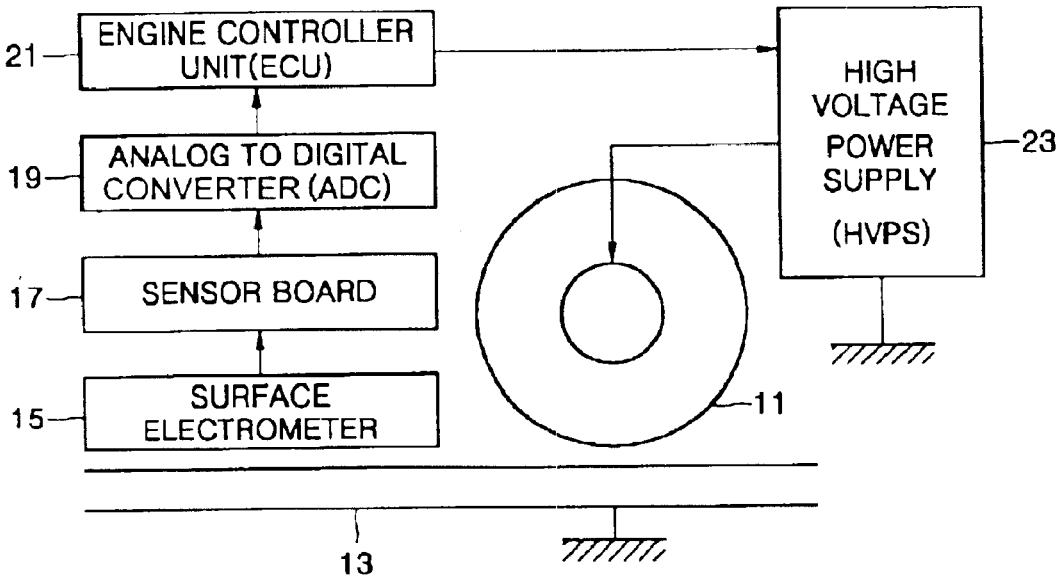
FIG. 1 (PRIOR ART)
FIG. 1 is a schematic view illustrating a conventional method of controlling a charging potential of a conductive roller in a charging mechanism having a surface electrometer.
Figure 2:
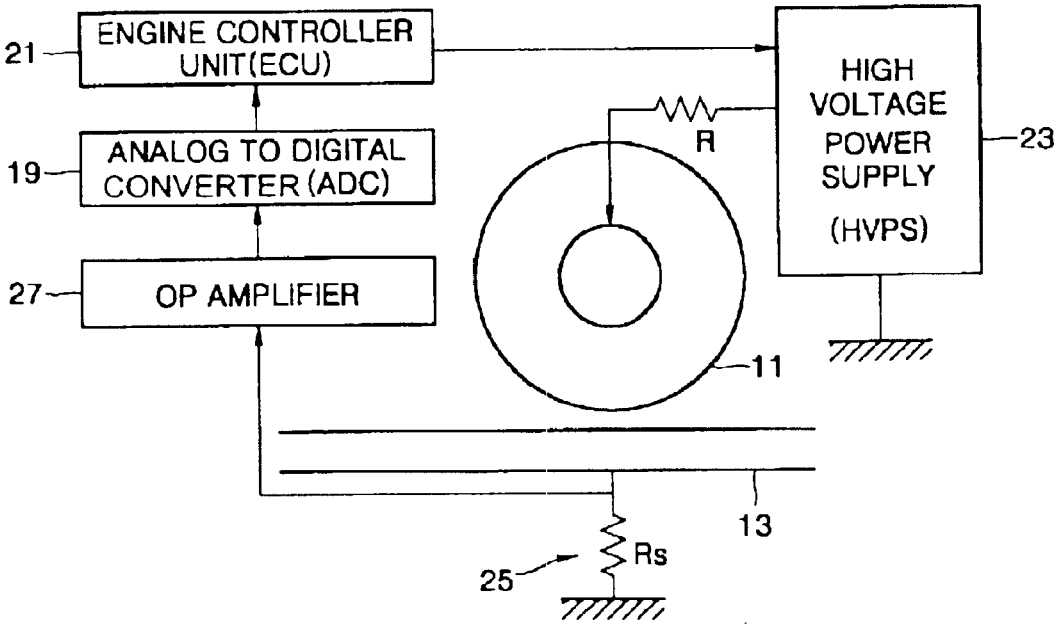
FIG. 2 (PRIOR ART)
FIG. 2 is a schematic view illustrating a conventional method of controlling a charging potential of a conductive roller in a charging mechanism having a sensing resistor.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

A method of controlling a charging potential according to an embodiment of the present invention will now be described with reference to the attached drawings. A charging voltage denotes a voltage supplied from a high voltage power supply (HVPS) to a conductive roller, and a charging potential denotes a surface potential of an organic photoconductive cell (OPC) after a charging operation of the conductive roller using the charging voltage. Here, the charging potential and an OPC voltage have the same meaning.

Figure 3A:
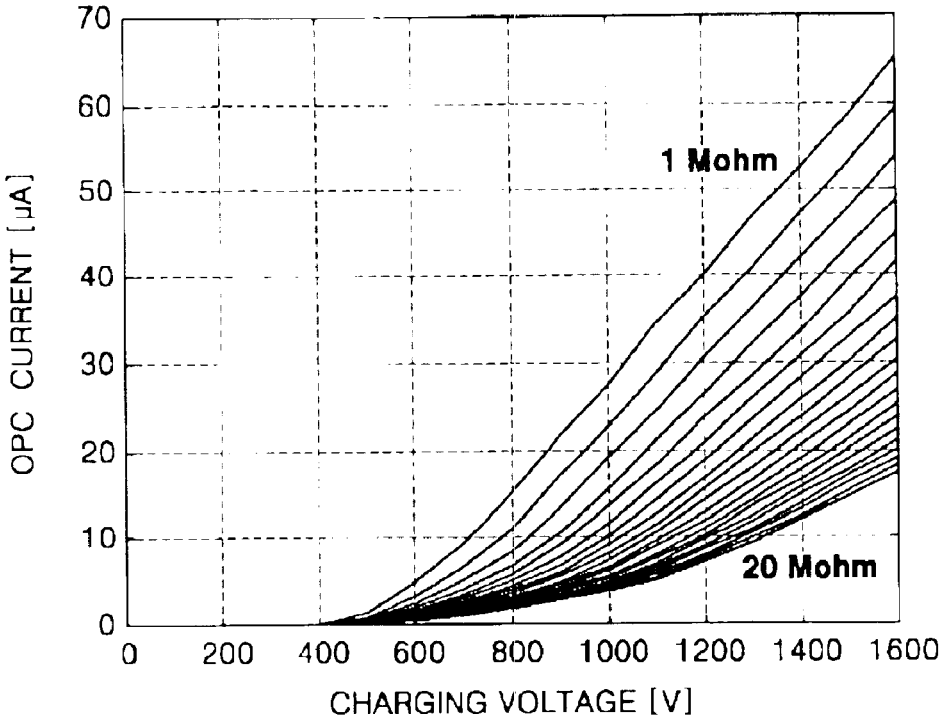
FIG. 3A is a graph illustrating a relationship between a charging voltage of a conductive roller and a charging current, i.e., organic photoconductive cell (OPC) current, of an OPC when a residual potential of the OPC is uniform.
Figure 3B:
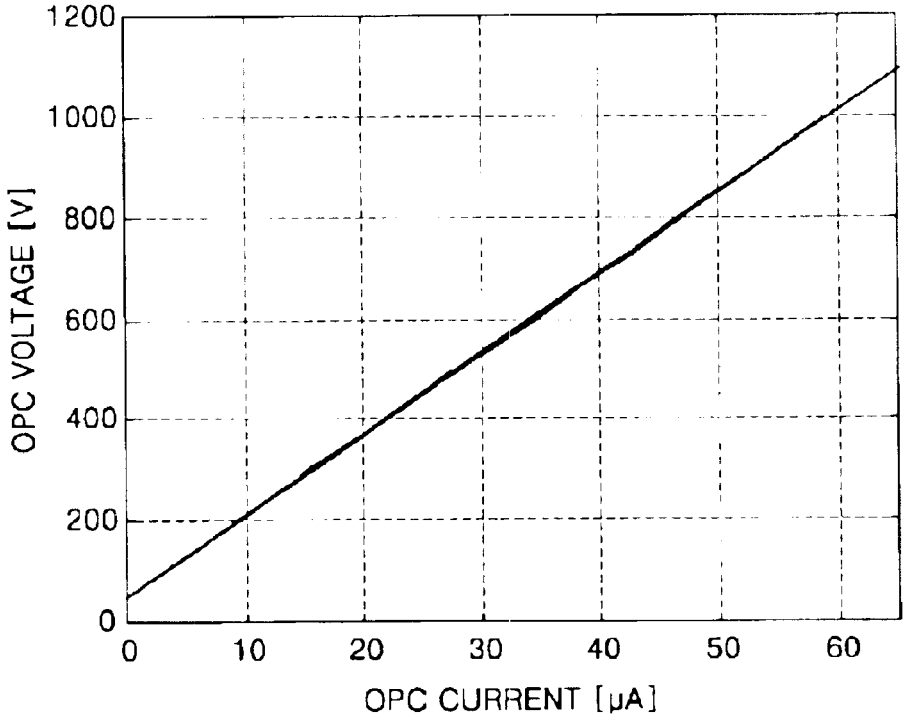
FIG. 3B is a graph illustrating a relationship between a charging current, i.e., OPC current, and a charging potential, i.e., OPC voltage, of an OPC when a residual potential of the OPC is uniform.

FIGS. 3A and 3B illustrate graphs showing a charging characteristic when a residual potential of the OPC is uniform, and only a resistance of the conductive roller varies according to changes in temperature.

Referring to FIG. 3A, when the charging voltage is uniform, as the resistance of the conductive roller increases, a charging current, i.e., OPC current, of the OPC decreases, and a threshold voltage for starting discharging the charging voltage from the conductive roller to the OPC increases.

For example, in a case of the charging voltage of 1000 V, when the conductive roller has the resistance of 1 M ohm, the OPC current is about 28 $\mu$A, and the conductive roller has a resistance of 20 M ohm, the OPC current becomes 4 $\mu$A. In addition, in a case of the charging voltage of 1000 V, when the resistance of the conductive roller is 1 M ohm, the threshold voltage is 400 V, and the resistance of the conductive roller is 20 M ohm, the threshold voltage becomes 600 V.

Referring to FIG. 3B, the charging current, i.e., the OPC current, and a charging potential, i.e., an OPC voltage, of the OPC are in a linear proportional relationship having an equivalent resistance. Here, a gradient of the graph of FIG. 3B denotes the resistance of the OPC.

As shown in FIGS. 3A and 3B, when a residual potential of the OPC is uniform, the OPC current increases in proportion to the charging voltage of the conductive roller while the OPC voltage, i.e., the charging potential, increases at a fixed rate. Accordingly, when the residual potential of the OPC is uniform, the charging potential of the OPC can be controlled to be uniform by using a conventional method which uses an algorithm for compensating for only the charging potential. However, when the residual potential of the OPC varies, the linear proportional relationship between the charging current, i.e., the OPC current, and the charging potential, i.e., the OPC voltage, is not available any longer.

Figure 4A:
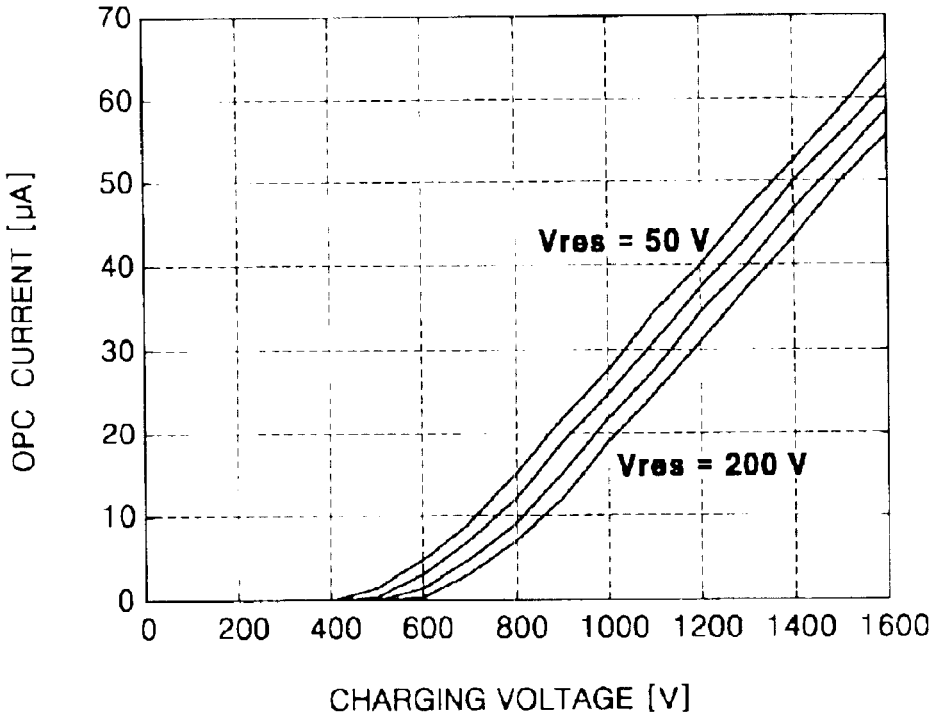
FIG. 4A is a graph illustrating a relationship between a charging voltage of a conductive roller and a charging current, i.e., OPC current, of an OPC when a residual potential of the OPC varies.
Figure 4B:
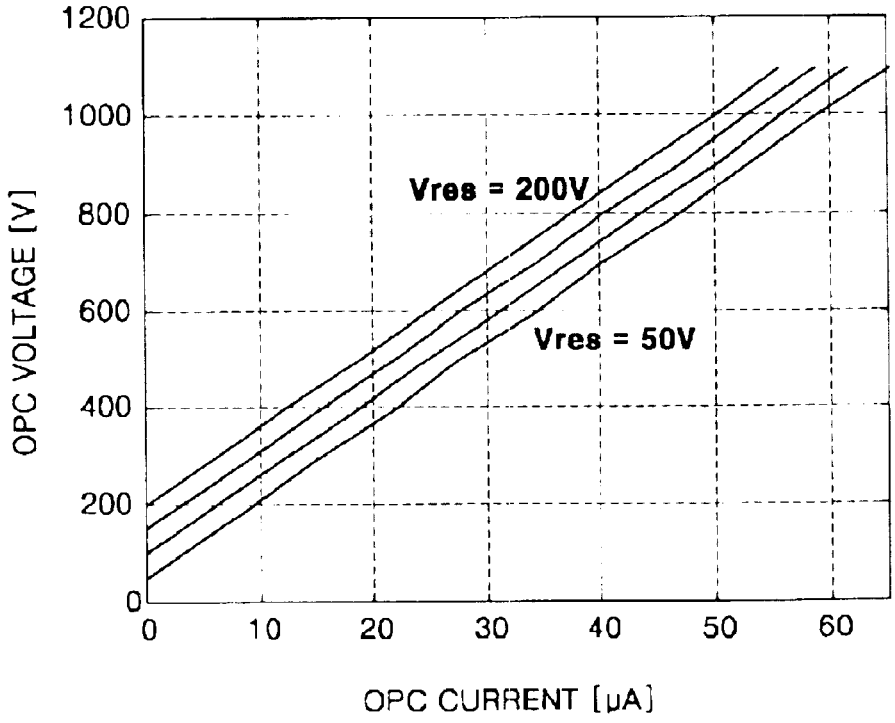
FIG. 4B is a graph illustrating a relationship between a charging current, i.e., OPC current, and a charging potential, i.e., OPC voltage, of an OPC when a residual potential of the OPC varies.

FIGS. 4A and 4B are graphs illustrating changes in the charging characteristic of the OPC when the resistance of the conductive roller is uniform while a residual potential Vres of the OPC varies.

Referring to FIG. 4A, when the charging voltage of the conductive roller is uniform, as the residual potential Vres of the OPC increases, the OPC current decreases. Accordingly, when the residual potential Vres is high, the charging voltage of the conductive roller has to be increased to raise the OPC current.

Referring to FIG. 4B, unlike the graph of FIG. 3B, the linear proportional relationship having the same equivalent resistance values between the OPC current and the OPC voltage is not available, and the gradient of the graph, i.e., the equivalent resistance value, varies. When the OPC voltage is uniform, as the residual potential increases, the OPC current decreases so that a uniform OPC current can be obtained by increasing the OPC voltage while the residual potential is high.

It is known that when a residual potential characteristic of the OPC is changed according to changes in an environment of the printer or continuous use of the printer, the charging potential of the OPC cannot be maintained by simply maintaining the charging voltage of the conductive roller uniformly.

Accordingly, the method of controlling the charging potential provides an algorithm for maintaining the charging potential within a predetermined range by compensating for the charging current by adjusting the charging voltage of the conductive roller and a duty of the HVPS according to changes in a residual potential of the OPC.

Figure 5:
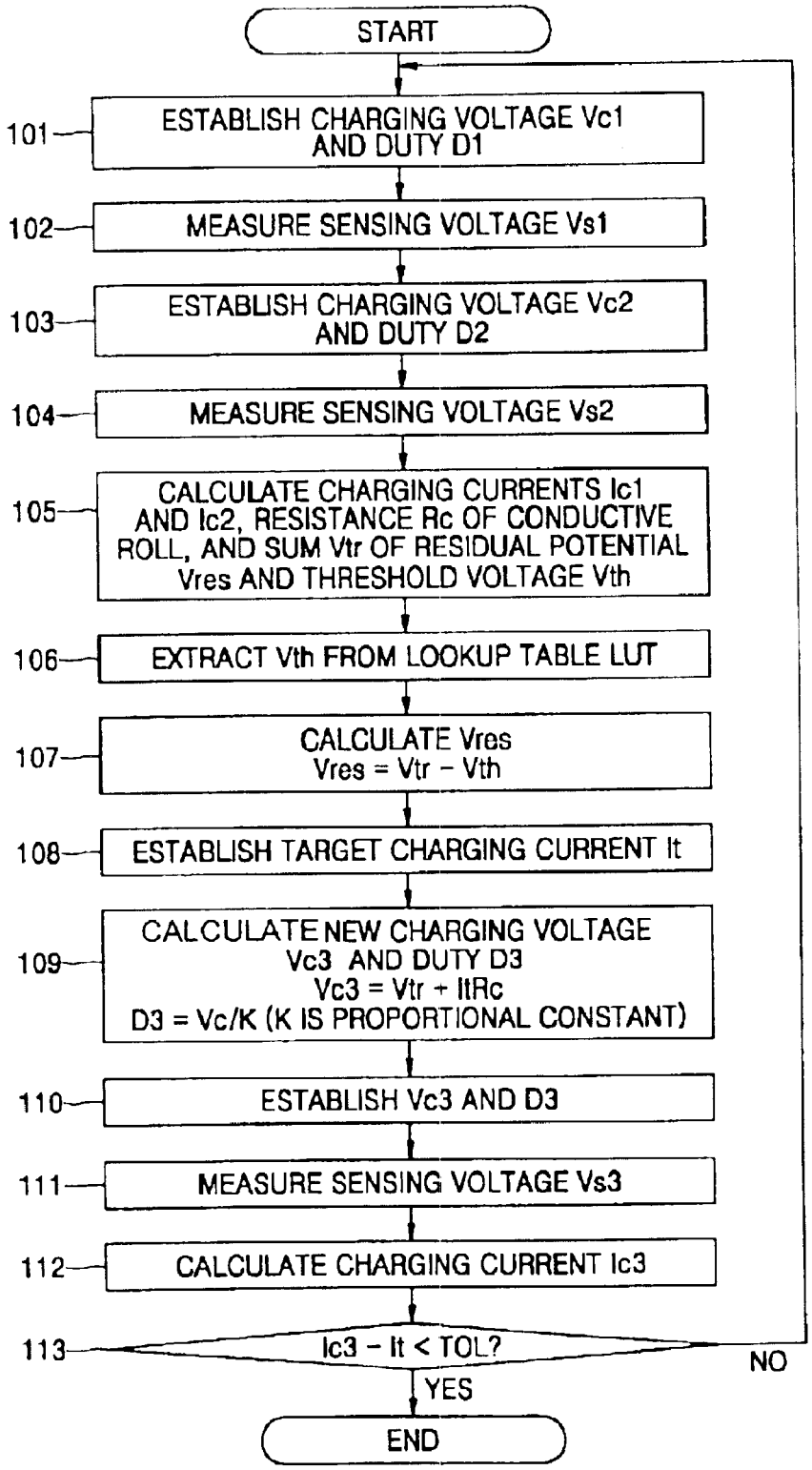
FIG. 5 is a flowchart for explaining a method of controlling a charging voltage of a conductive roller according to an embodiment of the present invention.
Figure 6A:
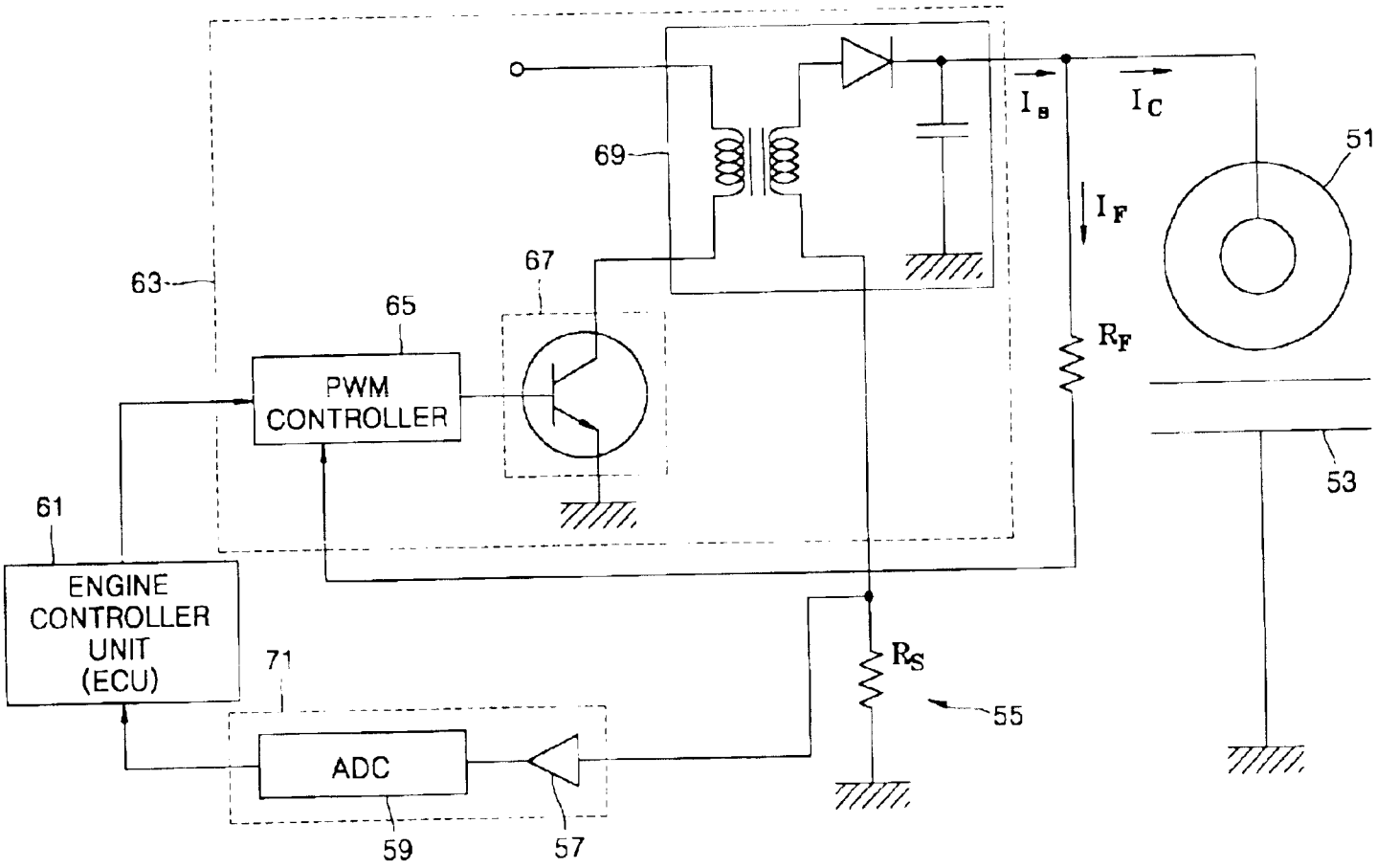
FIGS. 6A and 6B are block diagrams of a charging mechanism performing the method of controlling a charging voltage of a conductive roller shown in FIG. 5 according to an embodiment of the present invention.
Figure 6B:
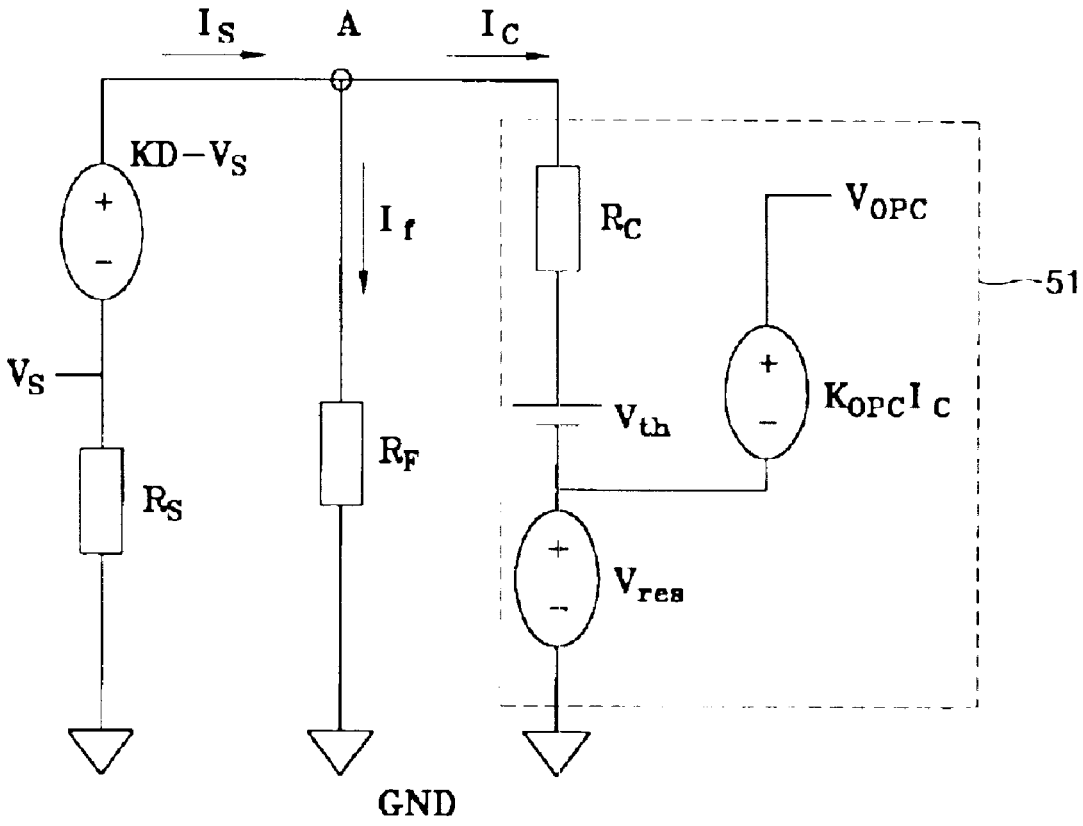

FIG. 5 is a flowchart illustrating an algorithm for the method of controlling the charging potential according to the present invention, and FIGS. 6A and 6B are block diagrams of a charging mechanism in which the algorithm of FIG. 5 is performed.

Referring to FIG. 6A, the charging mechanism includes a conductive roller 51 charging an OPC 53, an HVPS 63 supplying a high voltage to the conductive roller 51, an engine controller unit (ECU) 61 transferring a voltage signal to the HVPS 63, a sensing resistor Rs 55 used for measuring a charging potential Vopc, which is in proportion to a charging current Ic of the OPC 53, and a current sensing circuit 71 detecting a charging current Ic signal and transferring the same to the ECU 61.

The HVPS 63 includes a pulse width modulation (PWM) controller 65 outputting a pulse signal having a predetermined period and amplitude as a control signal, and a switch device 67 turning on/off a transformer 69 in response to an output signal of the PWM controller 65, i.e., a predetermined duty of the control signal.

The current sensing circuit 71 includes an amplifier 57 and an analog-to-digital converter (ADC) 59.

A potential of a node A (refer to FIG. 6B) can be controlled by a feedback of current sensing circuit 71 so that the node A is an electrostatic voltage source while the potential of the node A is in proportion to a PWM duty of the control signal (pulse signal) generated from the PWM controller 65. When Kirchhoff's voltage law (KVL) is applied to the node A, a relationship of Equation 7 is satisfied.

$$Ic = Is - If = \frac{Vs}{Rs} - \frac{KD}{Rf} \tag{7}$$

Here, Ic denotes the charging current, Is denotes a sensing current, If denotes a feedback current, Vs denotes a charging voltage, i.e., a sensing voltage, Rs denotes a sensing resistance, Rf denotes a feedback resistance, D denotes the PWM duty, and K denotes a proportional constant.

FIG. 6B illustrates an equivalent model schematically illustrating an equivalent circuit of a conductive roller 51 in an equivalent circuit shown in FIG. 6A.

Referring to FIG. 6B, an equivalent resistor Rc denotes a conductive roller 51 to which a sum Vtr of a threshold voltage Vth and a residual potential Vres except for a voltage supplied to the equivalent resistor Rc is supplied. When KVL is applied to the equivalent model of the conductive roller 51, Equation 8 is formed.

$$KD = Ic \times Rc + Vth + Vres = Ic \times Rc + Vtr \tag{8}$$

Here, unknown quantities Rc and Vtr of Equation 8 can be calculated from the simultaneous equation of Equation 9.

$$KD1 = Ic1 \times Rc + Vtr = Vc1$$

$$KD2 = Ic2 \times Rc + Vtr = Vc2 \tag{9}$$

Here, D2 is greater than D1, and Ic2 is greater than Ic1.

A solution of the simultaneous equation of Equation 9 can be obtained from Equations 1 through 4.

Accordingly, when sensing voltages Vs1 and Vs2 are measured at different duties D1 and D2, the equivalent resistance of the conductive roller 51 and the sum Vtr of the residual potential Vres and the threshold voltage Vth can be calculated by using Equations 1 through 4.

The duties D1, D2 are controlled by the PWM controller 65 in response to the feedback current (voltage) transmitted through the feedback resistance Rf and the voltage signal output from the engine controller unit 61 in response to the sensing voltages Vs1 and Vs2 detected by the current sensing circuit 71. The charging voltages Vc1 and Vc2 are proportional to the duties D1 and D2, respectively.

Since a discharge potential Vera of the OPC 53 is proportional to a charging potential Vopc in a discharging process, Equation 10 is formed.

$$Vera=Kera(Vopc-Vres)+Vres \quad (10)$$

Since the charging potential Vopc is a sum of the discharge potential Vera and an increase in voltage by a charging process, Equation 11 is formed.

$$Vopc=Kopc\times Ic+Vera=Kopc\times Ic+Kera\times Vopc+(1-Kera)Vres \quad (11)$$

Equation 11 can be represented as Equation 12 so that the charging potential Vopc is proportional to the charging current Ic.

$$Vopc=\frac{KopcIc}{1-Kera}+Vres=\Delta Vopc+Vres=KopcIc+Vres \quad (12)$$

In order to uniformly maintain the charging potential Vopc, variations of the resistance of the conductive roller 51 due to changes in temperature and moisture and variations of the residual potential Vres due to a temporal change of the OPC 53 have to be compensated.

The present invention compensates for the charging voltage and the duty so that the charging potential of the OPC can be maintained to be uniform regardless of changes in the characteristic of the OPC, i.e., changes in the residual potential.

To this end, the algorithm for compensating for the residual potential by using the circuits of FIGS. 6A and 6B is provided as shown in FIG. 5.

Referring to FIG. 5, in order to eliminate the charging potential Vopc by using the charging mechanism shown in FIGS. 6A and 6B, the ECU 61 establishes a first charging voltage Vc1 and a first duty D1 in operation 101. Thereafter, the ECU 61 outputs the voltage signal to the HVPS 63 so that the HVPS 63 increases the first charging voltage Vc1 of the conductive roller 51 according to the voltage signal of the ECU 61, and the conductive roller 51 accumulates corona ions on the OPC by using a Townsend discharge so as to increase the charging potential Vopc of the OPC.

A first sensing voltage Vs1 proportional to the charging potential Vopc is measured by using the sensing voltage (charging voltage) Vs in operation 102, and the ECU 61 establishes a second charging voltage Vc2 and a second duty D2 that are different from the first charging voltage Vc1 and the first duty D1 in operation 103.

The ECU 61 outputs signals corresponding to the second charging voltage Vc2 and the second duty D2 to the HVPS 63 so as to increase the charging voltage Vc of the conductive roller 51. Thereafter, a second sensing voltage Vs2 proportional to a second charging potential of the OPC 53, which is charged by the conductive roller 51, is measured in operation 104.

By substituting the first and second charging voltages Vc1 and Vc2, the first and second duties D1 and D2, and the measured first and second sensing voltages Vs1 and Vs2 into Equations 1 through 4, charging currents Ic1 and Ic2, the resistance Rc of the conductive roller 51, and the sum Vtr of the residual potential Vres and the threshold voltage Vth can be calculated in operation 105.

Here, since changes in the resistance Rc of the conductive roller 51 vary the threshold voltage Vth, the threshold voltages Vth corresponding to the resistance Rc of the conductive roller 51 can be extracted from a lookup table (LUT), which is obtained from experimental results, in operation 106.

| Rc (Mohm) | 16.8 | 17.9 | 19.9 |
|---|---|---|---|
| Vth (V) | 520 | 540 | 580 |

Since the residual potential Vres can be calculated by subtracting the threshold voltage Vth from the sum Vtr of the residual potential Vres and the threshold voltage Vth, a specific threshold voltage Vth selected from the LUT is substituted into Equation 13 to obtain a new residual potential Vres.

$$Vres=Vtr-Vth \quad (13)$$

In operation 108, the target charging current It is established in response to changes in the charging current, i.e., the OPC current, with respect to changes in the charging voltage according to the calculated residual potential Vres as shown in FIG. 4A. Thereafter, a new third charging voltage Vc3 and a new third duty D3 are calculated by using Equations 5 and 6 in operation 109. Here, when the residual potential Vres is increased by the temporal change of the OPC, the target charging current It is decreased. When the residual potential Vres is decreased, the target charging current It is increased.

After the new third charging voltage Vc3 is established by using the HVPS 63, the third charging voltage Vc3 and the third duty D3 are applied to the conductive roller 51 to measure a third sensing voltage Vs3 while calculating a third charging current Ic3 by using Equation 14 in operation 112.

$$Ic3=\frac{Vs3}{Rs}-\frac{KD3}{Rf} \quad (14)$$

A difference between the calculated third charging current Ic3 and the target charging current It is compared with a tolerance value TOL. When the difference is smaller than the tolerance value TOL, the algorithm is finished controlling the charging potential of the charging mechanism by using the target charging current It.

When the difference is larger than the tolerance value TOL, the algorithm is repeated from operation 101 until the difference between the third charging current Ic3 and the target charging current It becomes smaller than the tolerance value TOL.

Figure 7A:
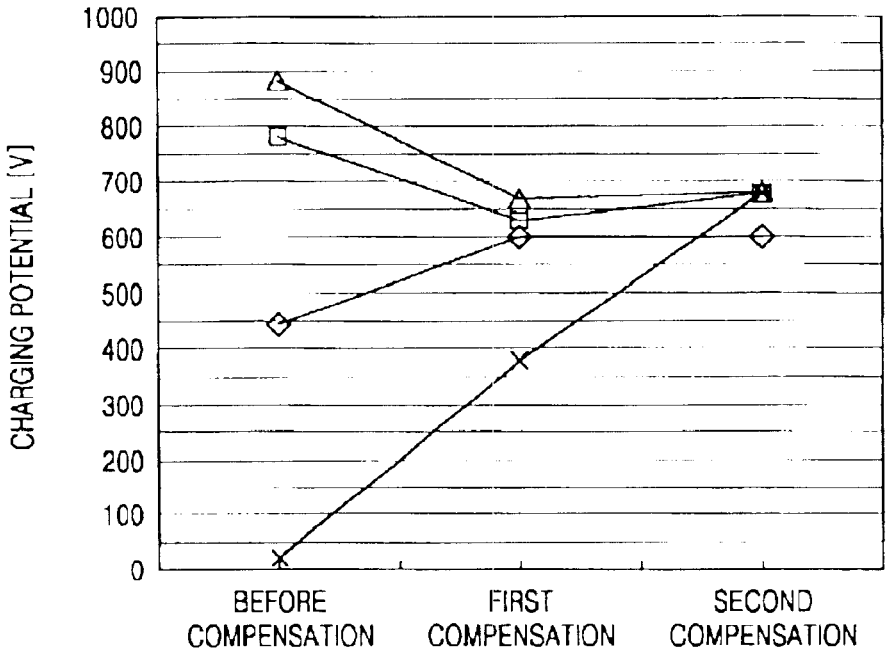
FIGS. 7A and 7B are graphs illustrating charging potentials after compensating for a residual potential by using a method of controlling a charging potential of a conductive roller shown in FIG. 5 according to another embodiment of the present invention.
Figure 7B:
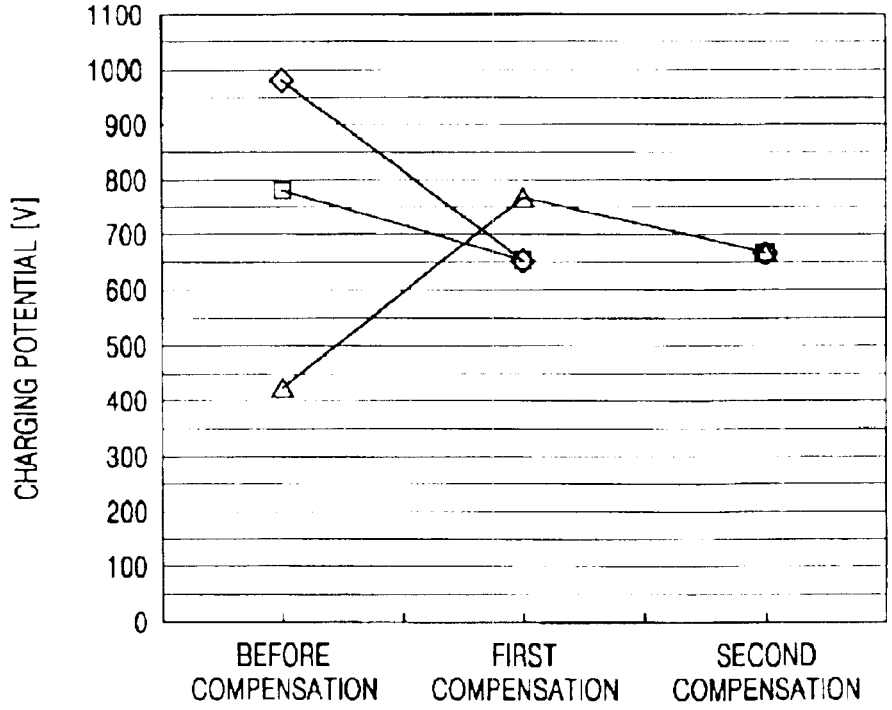

FIGS. 7A and 7B are graphs illustrating experimental results of the method of controlling the charging potential when temperatures and moistures are low and high, respectively.

Referring to FIG. 7A, charging potentials of 20, 450, 780, and 890 V before compensation become charging potentials of 350, 600, 640, and 680 V after a first compensation. Thereafter, the charging potentials are converged to charging potentials of 600 and 675 V after a second compensation.

Referring to FIG. 7B, charging potentials of 420, 780, and 990 V before the compensation become charging potentials of 650 and 760 V after a first compensation. Thereafter, the charging potentials are converged to a new charging potential of 660 V after a second compensation.

According to the present invention, the algorithm estimates the equivalent resistance, the threshold voltage, and the residual potential of the conductive roller by the conductive current circuit analysis of the conductive roller and changes the target charging current based on the estimated results to stabilize the charging potential. Thus, the charging potential can be controlled regardless of changes in the potential characteristic of the OPC.

It is noted that the present invention is not limited to the embodiments described above, and it is apparent that variations and modifications by those skilled in the art can be effected within the spirit and scope of the present invention defined in the appended claims.

For example, those skilled in the art can compose an algorithm by finely dividing a charging voltage and a duty or prepare an LUT of a threshold voltage for an equivalent resistance of a conductive roller, in detail, by performing experiments.

By using a method of controlling a charging potential according to the present invention, changes in a residual potential of an OPC are compensated so that a charging potential of the OPC can be maintained to be uniform regardless of changes in a characteristic of the OPC. Therefore, an overall performance of a printer can be improved.

Although a few preferred embodiments of the present invention have been shown and described, it would be appreciated by those skilled in the art that changes may be made in this embodiment without departing from the principles and sprit of the invention, the scope of which is defined in the claims and their equivalents.

What is claimed is:

1. A method of controlling a charging potential of a charging mechanism including a conductive roller charging an organic photoconductive cell (OPC), a sensing resistor Rs measuring a sensing voltage, which is proportional to a charging potential of the OPC, an analog-to-digital converter (ADC) converting an analog signal corresponding to a voltage variation of the sensing resistor (Rs) to a digital signal, an engine controller unit (ECU) receiving the digital signal from the ADO and outputting a control signal for controlling a charging voltage (Vc) and a duty of a high voltage power supply (HVPS), and the HVPS receiving the control signal from the ECU and applying the charging voltage (Vc) to the conductive roller in a printer, the method comprising performing:

a first operation of supplying first and second charging voltages (Vc1 and Vc2) and first and second duties (D1 and D2) established in the ECU to the conductive roller via the HVPS to charge the OPC;

a second operation of measuring first and second sensing voltages (Vs1 and Vs2) of the sensing resistor (Rs) so that the ECU establishes a target charging current (It) and calculates a new third charging voltage (Vc3) and a new third duty (D3);

a third operation of supplying the new third charging voltage (Vc3) and the new third duty (D3) to the conductive roller via the HVPS to charge the OPC and measuring a charging current (Ic3) of the conductive roller; and a fourth operation of comparing a difference between the charging current (Ic3) of the conductive roller and the target charging current (It) with a tolerance value TOL to control the charging potential by using the target charging current (It) when the difference is smaller than the tolerance value TOL.

2. The method of claim 1, wherein the performing of the second operation further comprises:

calculating first and second charging currents (Ic1 and Ic2), an equivalent resistance (Rc) of the conductive roller, and a sum (Vtr) of a residual potential (Vres) and a threshold voltage (Vth) by using the following formulas:

$$Ic1 = \frac{Vs1}{Rs} - \frac{KD1}{Rf}$$

$$Ic2 = \frac{Vs2}{Rs} - \frac{KD2}{Rf}$$

$$Rc = \frac{Vc2}{Ic2} - \frac{Vc1}{Ic1}$$

$$Vtr = KD1 - Ic1 \times Rc = KD2 - Ic2 \times Rc,$$

where Vc1 and Vc2 are the first and second charging voltages, D1 and D2 are the first and second duties, Vs1 and Vs2 are the first and second sensing voltages, Rf is a feedback resistance connected to the conductive roller in a series to transfer a feedback current (If) to the HVPS, and K is a proportional constant;

extracting the residual potential (Vres) for the equivalent resistance (Rc) from a lookup table (LUT) to calculate a new residual potential (Vres) by using the sum (Vtr);

establishing the target charging current (It) from the new residual potential (Vres); and calculating a new charging voltage (Vc3) and a new duty (D3) from the target charging current (It).

3. The method of claim 2, wherein the establishing of the target charging current (It) comprises:

increasing the target charging current (It) in response to an increase of the residual potential (Vres); and decreasing the target charging current (It) in response to a decrease of the residual potential (Vres).

4. The method of claim 3, wherein the calculating of the charging voltage (Vc3) and the duty (D3) comprises:

obtaining the charging voltage (Vc3) and the duty (D3) from the following formulas:

$$Vc3 = Vtr + ItRc$$

$$D3 = \frac{Vc}{K},$$

where Rc is the equivalent resistance, and K is the proportional constant.

5. The method of claim 1, wherein the performing of the fourth operation further comprises:

controlling the charging mechanism by using the target charging current (It) when the difference between the target charging current (It) and the charging current (Ic3) of the conductive roller is smaller than the tolerance value TOL; and repeating the performing of the first through third operations until the difference between the target charging current (It) and the charging current (Ic3) of the conductive roller becomes smaller than the tolerance value TOL when the difference between the target charging current (It) and the charging current (Ic3) of the conductive roller is larger than the tolerance value TOL.

6. A method of controlling a charging potential of a charging mechanism including a conductive roller charging an organic photoconductive cell (OPC) in a printer, the method comprising:

supplying first and second charging voltages and first and second duties to the conductive roller using an engine controller unit and a high voltage power supply connected to the conductive roller to charge the OPC;

measuring first and second sensing voltages of the conductive roller using a current sensing unit connected between the conductive roller and the engine controller unit in response to the first and second charging voltages and the first and second duties;

generating first and second charging currents from the first and second sensing voltages;

generating a target charging current in response to the first and second charging currents; and controlling the charging mechanism in response to the target charging current.

7. The method of claim 6, wherein the generating of the target charging current comprises:

calculating a resistance of the conductive roller, a residual potential of the OPC, and a threshold voltage of the conductive roller in response to the first and second sensing voltages, the first and second charging voltages, and the first and second duties; and calculating the target charging current in response to a first change in the resistance of the conductive roller, a second change in the residual potential of the OPC, and a third change in the threshold voltage of the conductive roller.

8. The method of claim 7, wherein the generating of the target charging current comprises:

decreasing the target charging current when the residual potential increases in response to a temporal change of the OPC; and increasing the target charging current when the residual potential decreases in response to the temporal change of the OPC.

9. The method of claim 6, wherein the controlling of the charging mechanism comprises:

calculating a third charging voltage and a third duty in response to the target charging current; and supplying the third charging voltage and the third duty to the conductive roller using the an engine controller unit and the high voltage power supply.

10. The method of claim 9, wherein the controlling of the charging mechanism comprises:

compensating for a change in a residual voltage of the OPC by supplying the third charging voltage and the third duty to the conductive roller.

11. The method of claim 9, wherein the controlling of the charging mechanism comprises:

detecting a third sensing voltage of the conductive roller using the current sensing unit; and measuring a third charging current of the conductive roller in response to the third sensing voltage.

12. The method of claim 11, wherein the controlling of the charging mechanism comprises:

modifying the third charging voltage and the third duty to be supplied to the conductive roller.

13. The method of claim 11, wherein the controlling of the charging mechanism comprises:

calculating a difference between the target charging current and the third charging current;

comparing the difference with a tolerance value; and controlling the charging mechanism according to the target charging current when the difference is smaller than the tolerance value.

14. The method of claim 13, wherein the controlling of the charging mechanism comprises:

modifying the target charging current when the difference is greater than the tolerance value.

15. The method of claim 13, wherein the controlling of the charging mechanism comprises:

supplying fourth and fifth charging voltages and fourth and fifth duties to the conductive roller using the engine controller unit and the high voltage power supply connected to the conductive roller to charge the OPC when the difference is greater than the tolerance value;

measuring fourth and fifth sensing voltages of the conductive roller using the current sensing unit in response to the fourth and fifth charging voltages and the fourth and fifth duties, generating fourth and fifth charging currents from the fourth and fifth sensing voltages, and generating a second target charging current in response to the fourth and fifth charging currents; and controlling the charging mechanism in response to the second target charging current.

16. The method of claim 6, wherein the high voltage power supply comprises a transformer having a first end coupled to the conductive roller and a second end coupled to the current sensing circuit, and the supplying of the first and second charging voltages and the first and second duties to the conductive roller comprises:

detecting a feedback current from the first end of the transformer; and generating the first and second duties in response to the feedback current.

17. An apparatus for controlling a charging potential of a charging mechanism including a conductive roller charging an organic photoconductive cell (OPC) in a printer, comprising:

a high voltage power supply having a transformer supplying first and second charging voltages and first and second duties to the conductive roller connected to the conductive roller to charge the OPC;

a sensing resistor coupled between the transformer and a reference potential;

a current sensing circuit measuring first and second sensing voltages of the conductive roller in response to the first and second charging voltages and the first and second duties; and an engine controller unit generating first and second charging currents from the first and second sensing voltages, generating a target charging current in response to the first and second charging currents, and controlling the high voltage power supply and the charging mechanism in response to the target charging current.

18. The apparatus of claim 17, wherein the engine controller unit calculates:

a resistance of the conductive roller, a residual potential of the OPC, and a threshold voltage of the conductive roller in response to the first and second sensing voltages, the first and second charging voltages, and the first and second duties; and the target charging current in response to a first change in the resistance of the conductive roller, a second change in the residual potential of the OPC, and a third change in the threshold voltage of the conductive roller.

19. The method of claim 18, wherein the engine controller unit decreases the target charging current when the residual potential increases in response to a temporal change of the OPC, and increases the target charging current when the residual potential decreases in response to the temporal change of the OPC.

20. The method of claim 18, wherein the engine controller unit calculates a third charging voltage and a third duty in response to the target charging current, and the high voltage power supply supplies the third charging voltage and the third duty to the conductive roller to compensate for the second change in the residual potential of the OPC.

21. An apparatus for controlling a charging potential of a charging mechanism including a conductive roller charging an organic photoconductive cell (OPC) in a printer, comprising:

a high voltage power supply having a transformer supplying a charging voltage to the conductive roller to charge the OPC;

a sensing resistor coupled between the transformer and a reference potential;

a current sensing circuit detecting a charging potential, which represents one of the charging voltage of the conductive roller and a charging current of the OPC, between the sensing resistor and the transformer, and generating a charging current signal, comprising;

an amplifier receiving the charging potential from the transformer through the sensing resistor and generating an analog signal, and an analog to digital converter converting the analog signal to a digital signal as the charging current signal; and an engine controller unit generating a voltage signal in response to the charging current signal to control the high voltage power supply to adjust the charging voltage to be supplied to the conductive roller.

22. The apparatus of claim 21, wherein the high voltage power supply comprises:

a PWM controller receiving the voltage signal from the engine controller and generating a control signal; and a switching device turning on and off the transformer in response to the control signal.

23. The apparatus of claim 22, further comprising:

a feedback resistor coupled between the transformer and the PWM controller, wherein the PWM controller adjust the control signal in response to a feedback current transmitted through the feedback resistor.

24. The apparatus of claim 23, wherein the transformer comprises:

a primary winding connected to the switching device; and a secondary winding connected to the conductive roller and the sensing resistor.

25. The apparatus of claim 24, wherein the secondary winding comprises:

a first end connected to the conductive roller and the feedback resistor; and a second end connected to the sensing resistor.

26. The apparatus of claim 21, wherein the engine controller unit controls the high voltage power supply to supply first and second charging voltages and first and second duties to the conductive roller, and the current sensing circuit measures first and second sensing voltages of the conductive roller in response to the first and second charging voltages and the first and second duties, respectively.

27. The apparatus of claim 26, wherein the engine controller unit calculates a target charging current according to the first and second sensing voltages and controls the high voltage power supply to supply a third charging voltage and a third duty to the conductive roller according to the target charging current.

28. The apparatus of claim 27, wherein the current sensing circuit measures a third sensing voltage from the conductive roller in response to the third charging voltage and the third duty, and the engine controller unit calculates a third charging current from the third sensing voltage.

29. The apparatus of claim 28, wherein the engine controller unit calculates a difference between the third charging current and compares the difference with a tolerance value.

30. The apparatus of claim 29, wherein the engine controller unit modifies the first and second charging voltages and the first and second duties.

31. The apparatus of claim 29, wherein the engine controller unit modifies the target charging current.

32. The apparatus of claim 29, wherein the engine controller unit modifies the third charging voltage and the third duty.

33. The apparatus of claim 21, wherein the high voltage power supply directly receives the voltage signal from the engine controller unit.

34. An apparatus for controlling a charging potential of a charging mechanism including a conductive roller charging an organic photoconductive cell (OPC) in a printer, comprising:

a high voltage power supply having a transformer supplying a charging voltage to the conductive roller to charge the OPC, comprising:

a PWM controller receiving the voltage signal from the engine controller and generating a control signal, and a switching device turning on and off the transformer in response to the control signal;

a sensing resistor coupled between the transformer and a reference potential;

a current sensing circuit detecting a charging potential, which represents one of the charging voltage of the conductive roller and a charging current of the OPC, between the sensing resistor and the transformer, and generating a charging current signal; and an engine controller unit generating a voltage signal in response to the charging current signal to control the high voltage power supply to adjust the charging voltage to be supplied to the conductive roller.

* * * * *

UNITED STATES PATENT AND TRADEMARK OFFICE

CERTIFICATE OF CORRECTION

PATENT NO. : 6,842,591 B2
DATED : January 11, 2005
INVENTOR(S) : Woo-jung Shim et al.

It is certified that error appears in the above-identified patent and that said Letters Patent is hereby corrected as shown below:

Title page,
Item [57], ABSTRACT,
Line 9, change "it" to -- It --;

Column 9,
Line 37, change "ADO" to -- ADC --;

Column 11,
Line 37, delete "an";

Column 13,
Line 18, change ";" to -- : --.

Signed and Sealed this

Second Day of August, 2005

JON W. DUDAS
*Director of the United States Patent and Trademark Office*